US008928483B2

(12) United States Patent
Nasir et al.

(10) Patent No.: US 8,928,483 B2
(45) Date of Patent: Jan. 6, 2015

(54) AUTOMATED ATTENDANCE TRACKING AND EVENT NOTIFICATION

(75) Inventors: Azim Nasir, Foxboro, MA (US); Afshin Moshrefi, Newburyport, MA (US); Nader Gharachorloo, Ossining, NY (US)

(73) Assignee: Verizon Patent and Licensing Inc., Basking Ridge, NJ (US)

( * ) Notice: Subject to any disclaimer, the term of this patent is extended or adjusted under 35 U.S.C. 154(b) by 794 days.

(21) Appl. No.: 12/975,567

(22) Filed: Dec. 22, 2010

(65) Prior Publication Data

US 2012/0161971 A1 Jun. 28, 2012

(51) Int. Cl.
*G08B 23/00* (2006.01)
*G07C 1/10* (2006.01)

(52) U.S. Cl.
CPC ..... *G07C 1/10* (2013.01)
USPC ..... 340/573.4; 455/456.1; 455/556.1

(58) Field of Classification Search
USPC ..... 340/573.4; 455/456.1, 556.1, 550.1; 348/552; 705/32
See application file for complete search history.

(56) References Cited

U.S. PATENT DOCUMENTS

| | | | | |
|---|---|---|---|---|
| 2003/0004776 | A1* | 1/2003 | Perrella et al. | 705/9 |
| 2003/0020623 | A1* | 1/2003 | Cao et al. | 340/686.6 |
| 2003/0069899 | A1* | 4/2003 | Brown et al. | 707/200 |
| 2004/0066276 | A1* | 4/2004 | Gile et al. | 340/5.53 |
| 2006/0258366 | A1* | 11/2006 | Oki et al. | 455/456.1 |
| 2007/0165649 | A1* | 7/2007 | Moritz | 370/395.64 |
| 2007/0244633 | A1* | 10/2007 | Phillips et al. | 701/207 |
| 2011/0093876 | A1* | 4/2011 | Belz et al. | 725/12 |

* cited by examiner

*Primary Examiner* — Hai Phan
*Assistant Examiner* — Ojiako Nwugo

(57) ABSTRACT

A system is configured to receive information associated with a location of a user device; retrieve information associated with a location at which a user, of the user device, is to be during a period of time; determine whether to assign, to the user device, a late status or an absent status based on the location of the user device, the assigned location, and the period of time; assign a late status when the location of the user device does not match the assigned location when the period of time begins; send, to another user device, a notification that the user device is late to the assigned location based on the assigning of the late status; assign an absent status when the location of the user device does not match the assigned location during the period of time; and send to the other user device, another notification that the user device was absent from the assigned location based on the assigning of the absent status.

23 Claims, 8 Drawing Sheets

300

| | |
|---|---|
| USER ID 302 | CHUCK BROWN / 1234 |
| USER INFO 304 | AGE 6, MALE 1ST GRADE, PHYSICAL TRAITS |
| USER DEVICE INFO 305 | MDN1 |
| MORNING TRANS 306 | Bus ID: 113 07:15-07:55 |
| PERIOD 1 308-1 | RM1 |
| PERIOD 2 308-2 | RM3 |
| PERIOD 3 308-3 | GYM |
| PERIOD 4 308-4 | Cafeteria |
| PERIOD 5 308-5 | RM2 |
| PERIOD 6 308-6 | RM1 |
| PERIOD P 308-P | RM6 |
| AFTERNOON TRANS 310 | Bus ID:121 15:15 – 15:50 |
| SPECIAL NEEDS 312 | CONDITION A ALLERGY B |
| MEDICATION INFO 314 | MEDICATION A 1:00pm |
| AUTHORIZED PICKUP 316 | MR. OR MRS. MICHAEL BRADY |
| PARENT INFO 318-1 | USERNAME / PASSWORD/PIN ADDRESS / TELEPHONE NUMBER |
| PARENT INFO 318-2 | MDN2 |

320

FIG. 3

500

| USER ID 502 | USER INFO 504 | USER DEVICE INFO 506 | CURRENT PERIOD INDICATOR 508 | ASSIGNED LOCATION 510 | PRESENCE INDICATOR 512 | LOCATION INDICATOR 514 | TIME IN 516 | TIME OUT 518 | STATUS 520 | NOTIFICATION 522 |
|---|---|---|---|---|---|---|---|---|---|---|
| Chuck Brown | AGE 6 / 1st Grade | MDN1 | 1 | RM2 | PRESENT | RM2 | 8:58AM | - | ON TIME | NONE |
| Lucy Brown | Age 8 3rd Grade | IP2 | 1 | RM3 | PRESENT | RM3 | 9:12AM | - | LATE | TARDY |
| Patty Brown | Age 8 3rd Grade | MDN3 | 1 | RM3 | NOT PRESENT | LOC1 | | - | ABSENT | ABSENT |
| Sally Brown | Age 5 / Kindergarten | MDN4 | 1 | GYM | NOT PRESENT | RM5 | | 9:25PM | ABSENT | EXCUSED |
| ... | ... | ... | | | ... | | | ... | | |

524 526 528 530

FIG. 5A

AUTOMATED ATTENDANCE TRACKING AND EVENT NOTIFICATION

BACKGROUND

In an increasingly networked world, more and more traffic, such as data, voice, and video, is transmitted over public and proprietary networks. The public and proprietary networks provide a variety of services, such as voice communications, electronic mail, instant messaging, Internet-based services, security, etc. Applications, hosted by network devices within the networks, may provide a service associated with personnel attendance tracking and/or management. The applications may store, manage, and/or analyze information corresponding to personnel (e.g., personnel records, attendance records, vacation usage, etc.) associated with organizations that use the applications.

Information may be entered into an application by the personnel when entering and/or exiting a facility (e.g., when the personnel clock in and/or clock out, etc.) and/or by system administrators (e.g., when attendance is taken, when roll is called, when information associated personnel records is entered, etc.). The system may use the entered information to track attendance and/or manage the information associated with the personnel. Tracking the attendance and/or updating the information corresponding to the personnel throughout the day (e.g., between clocking in and/or clocking out) may be performed when the personnel frequently clock in and/or clock out when entering, moving about, and/or exiting the facility, when administrators frequently take attendance, etc. Unfortunately, the frequent clocking in and/or clocking out and/or taking attendance throughout the day may be cumbersome and/or time consuming for personnel and/or administrators.

BRIEF DESCRIPTION OF THE DRAWINGS

FIG. 3 is a diagram of an example personnel account set up data structure according to an implementation described herein;

FIGS. 5A and 5B are diagrams of example personnel data structures according to an implementation described herein.

DETAILED DESCRIPTION OF PREFERRED EMBODIMENTS

The following detailed description refers to the accompanying drawings. The same reference numbers in different drawings may identify the same or similar elements. Also, the following detailed description does not limit the embodiments described herein.

Systems and/or methods, described herein, may enable an automatic attendance tracking application (hereinafter referred to as "attendance application") to automatically determine whether a user, associated with a user device, is present or absent based on location information associated with the user device. As described herein, the attendance application may use information associated with whether a user device is present, tardy, or absent relative to a particular location (e.g., a school, a work place, a class room, a bus, etc.) to generate and/or update information associated with the user (e.g., attendance records, class rosters, personnel records, payroll records, etc.). The attendance application may determine whether a potential event, associated with the user, exists by determining whether the user device is missing, is excused from being absent, is excused from being late, etc. The attendance application may perform an operation to locate the user device in the event of an unexcused absence and/or when a potential event is detected. The attendance application may send notifications to the user device, another user device (e.g., associated with a parent, a physician, a guardian, etc. of the user), a client device (e.g., associated with a teacher, an administrator, a supervisor, etc. of the user), and/or governmental authorities (e.g., first responders and/or local, state, and/or federal officials, truant officers, etc.). The notifications may identify a status of the user device (e.g., on time, tardy, absent, etc.), a presence of the user device (e.g., present or not present), whether a late or absent status is excused, and/or whether a potential event has been detected. The notifications may identify a location of the user device (e.g., for use by first responders, truant officers, etc.), whether the user device is within a particular distance of an assigned location, whether the user device within a boundary specified by a parent of the user, etc. The attendance application may generate reports, such as personnel listings, class room rosters, attendance reports (e.g., a quantity of incidences of tardiness, absence, etc.), curriculum reports, etc.

The attendance application may enable less time to be spent managing attendance of personnel, which may permit more time to be spent performing other duties. The attendance application may permit the amount of time and/or funds associated with performing attendance data retrieval, attendance audits, record keeping, and/or reporting to be reduced. The attendance application may enable parents and/or supervisors to be kept informed as to the location and/or attendance status of children and/or employees, respectively.

Figure 1:
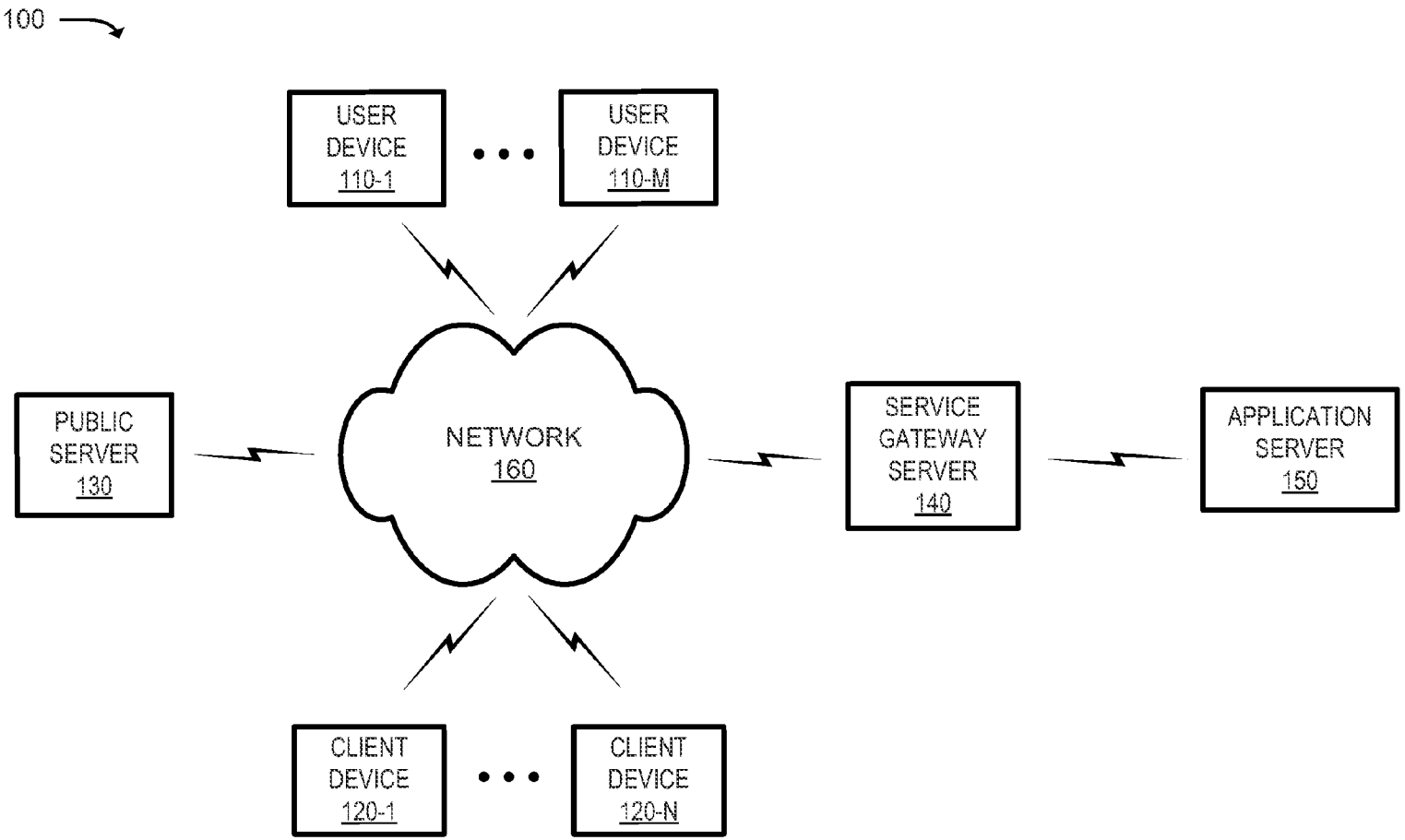
FIG. 1 is a diagram of an example environment in which systems and/or methods described herein may be implemented.

FIG. 1 is a diagram of an example environment 100 in which systems and/or methods, described herein, may be implemented. As shown in FIG. 1, environment 100 may include a group of user devices 110-1, . . . , 110-M (where M≥1) (hereinafter referred to collectively as "user devices 110" and individually as a "user device 110"), a group of client devices 120-1, . . . , 120-N (where N≥1) (hereinafter referred to collectively as "client devices 120" and individually as "client device 120"), a public server 130, a service gateway server 140 (hereinafter referred to as "SGW server 140"), an application server 150, and a network 160. The number of devices and/or networks, illustrated in FIG. 1, is provided for explanatory purposes only. In practice, there may be additional devices and/or networks, fewer devices and/or networks, different devices and/or networks, or differently arranged devices and/or networks than illustrated in FIG. 1.

Also, in some implementations, one or more of the devices of environment 100 may perform one or more functions described as being performed by another one or more of the devices of environment 100. Devices of environment 100 may interconnect via wired connections, wireless connections, or a combination of wired and wireless connections.

User device 110 may include any computation or communication device that is capable of communicating with network 160. For example, user device 110 may include a radiotelephone, a personal communications system (PCS) terminal (e.g., that may combine a cellular radiotelephone with data processing and data communications capabilities), a personal digital assistant (PDA) (e.g., that can include a radiotelephone, a smart phone, a pager, Internet/intranet access, etc.), a landline telephone, a laptop computer, a tablet computer, a personal computer, a set top box (STB), a radio frequency identification (RFID) device, a television, a camera, a personal gaming system, or another type of computation or communication device. The description to follow will generally refer to user device 110 as a wireless mobile device. The description is not limited, however, to a wireless mobile device and may equally apply to other types of user devices.

In an example implementation, user device 110 may include a location component that enables geographic location information, associated with user device 110, to be transmitted to SGW server 140 via network 160. The location information may be transmitted automatically, upon the occurrence of some event, periodically (e.g., every 30 seconds, 5 minutes, at particular times, etc.), and/or in response to a request from SGW server 140. For example, the location component may include a global positioning satellite (GPS) transponder that communicates with a GPS satellite constellation in order to obtain and/or generate location information associated with user device 110. In another example, user device 110 may transmit a signal (e.g., by transmitting Bluetooth® signal, by beaming a point-to-point infrared signal, etc.) to SGW server 140 (e.g., via a WIFI hot spot, an infrared sensor, and/or a wireless local area network (WLAN) that is hosted by, interconnected to, and/or controlled by SGW server 140) indicating that user device 110 is present and/or located at a particular location within or at a facility (e.g., a class room, gymnasium, a laboratory, etc.) and/or campus with which SGW server 140 is associated.

When communicating with SGW server 140, user device 110 may send the location information and/or the indication that user device 110 is present in a manner that includes information associated with user device 110. The information associated with user device 110 may include a device identifier (e.g., a mobile directory number (MDN), a subscriber identity module (SIM) universal resource identifier (URI), an international mobile subscriber identity (IMSI), an international mobile equipment identity (IMEI), a CODEC, etc.). Additionally, or alternatively, the information associated with user device 110 may include an address associated with user device 110 (e.g., a media access control (MAC) address, an IP address, a uniform resource locator (URL), etc.), information associated with a user of user device 110 (e.g., a username, password, personal identification number (PIN), biometric information, etc.), and/or information associated with an application hosted by user device 110 (e.g., an application identifier).

Client device 120 may include one or more server devices, or other types of computation or communication devices, that gather, process, search, store, and/or provide information in a manner similar to that described herein. Client device 120 may send, to SGW server 140 via network 160, information associated with a status of user device 110 and/or personnel information associated with a user of user device 110. For example, an operator of client device 120 (e.g., an administrator, a foreman, a teacher, etc.) may send an indication regarding whether a user, of user device 110, is present, absent, tardy, excused, etc. Client device 120 may store personnel information associated with the user (e.g., grades, attendance information, personal information, class schedules, curriculum information, job assignments, etc.) in a data structure stored in a memory associated with client device 120 and/or may send the personnel information and/or updates to the personnel information to SGW server 140. In an example implementation, client device 120 may receive a signal from user device 110 indicating that user device 110 is present and/or within a particular distance and/or range of client device 120 (e.g., within a classroom, facility, grounds, etc.) and client device 120 may send a status indication to SGW server 140 based on the signal received from user device 110. Client device 120 may permit an operator, of client device 120, to send an event notification that indicates that a potential emergency (e.g., a medical emergency, a fire, an act of violence, etc.) is about to occur, is in the process of occurring, or has occurred.

Client device 120 may receive notifications from SGW server 140 associated with user device 110. For example, client device 120 may receive an indication that an absence, associated with user device 110, is excused. In another example, client device 120 may receive a notification that a user, of user device 110, is to take particular medication at a prescribed time, is to report to a particular location, etc. Client device 120 may determine that a quantity of user devices 110 are present and/or that another quantity of user devices 110 are not present and may send information associated with the quantity of user devices 110 that are present and/or the other quantity of user devices 110 that are not present to SGW server 140. Client device 120 may provide recommendations to an operator based on information associated with the quantity of user devices that are present and the other quantity of user devices 110 that are not present. In one example, client device 120 may perform an operation to adjust a curriculum based on individual curricula associated with users, of user devices 110, that are present. In another example, client device 120 may adjust work schedules and/or tasks based on an expertise, skill, training, etc. associated with users of user devices 110 that are present.

Public server 130 may include one or more server devices, or other types of computation or communication devices, that gather, process, search, store, and/or provide information in a manner similar to that described herein. In an example implementation, public server 130 may be associated with government authorities at the federal, state, and/or local levels and/or may be associated with first responders in the event of an emergency and/or some other event (e.g., fire and rescue personnel, police, medical personnel, etc.).

Public server 130 may communicate with SGW server 140 via network 160. For example, public server 130 may send an event notification to SGW server 140 indicating that an event has occurred in close proximity to a facility at which SGW server 140 and/or user device 110 are located (e.g., a natural and/or man-made disaster, an accident, etc.). The notification may include instructions associated with the event notification (e.g., delay releasing students from school, instructions associated with alternative routes to avoid an accident, etc.). Public server 130 may receive an event notification from SGW server 140 indicating that a potential event has occurred at or near a facility at which SGW server 140, client device 120, and/or user device 110 are located. Public server 130 may receive the event notification and may alert authorities, first responders, and/or the public (e.g., an Amber alert, etc.) that the potential event has occurred based on the event notification. In another example, the event notification may include information associated with a location of user device 110 that first responders or other governmental authorities may use to location user device 110.

SGW server 140 may include one or more server devices, or other types of computation or communication devices, that gather, process, search, store, and/or provide information in a manner similar to that described herein. In an example implementation, SGW server 140 may act as a proxy and/or gateway device with respect to application server 150. When acting as the proxy and/or gateway device, SGW server 140 may manage communications, service provisioning, authentication operations, etc. on behalf of application server 150 when performing automated attendance tracking and/or event notification operations and/or other operations. SGW server 140 may, for example, communicate with user device 110 to obtain location information associated with user device 110. SGW server 140 may communicate with user device 110 to identify a position, within a facility and/or an area (e.g., such as a building, a room within the building, a grounds and/or campus on which the building is located, etc.), associated with user device 110. SGW server 140 may send the location information and/or the identified position, associated with user device 110, to application server 140. SGW server 140 may communicate with a variety of types of user devices 110 and/or client devices 120 using a variety of protocols, data formats, etc.

SGW server 140 may communicate with client device 120 to receive status information associated with user device 110 (e.g., absent, tardy, present, excused, etc.). SGW server 140 may receive the status information and may send the status information to application server 150. SGW server 140 may receive personnel information associated with the user (e.g., grades, attendance information, personal information, class schedules, curriculum information, job assignments, etc.) and may store the personnel information in a memory associated with SGW server 140 and/or may send the personnel information to application server 150.

SGW server 140 may receive notifications from application server 150 and may send the notifications to client device 120. For example, SGW server 140 may receive a notification that user device 110 will be absent on a particular day (e.g., due to a medical appointment of the user of user device 110) and may send the notification to client device 120 (e.g., to notify a foreman, teacher, etc. in advance of the absence, etc.).

Application server 150 may include one or more server devices, or other types of computation or communication devices, that gather, process, search, store, and/or provide information in a manner similar to that described herein. In an example implementation, application server 150 may host logic and/or software associated with an attendance application that enables application server 150 to perform automated attendance and/or event notification operations. Application server 150 may receive, from SGW server 140, location information associated with user device 110 and may determine a state associated with user device 110 based on the location information, a current time, and/or personnel information associated with a user of user device 110.

For example, application server 150 may receive the location information and may retrieve, from a memory associated with application server 150, personnel information associated with the user. The personnel information may include information that identifies a location and/or area within which user device 110 is to be located at a particular point in time. In one example, the personnel information may include a class schedule that includes starting and/or ending times, periods that correspond to the starting and/or ending times, classroom numbers that correspond to the periods, etc. The attendance application may, based on the location information, determine whether user device 110 is located at a location and/or within an area (e.g., within a facility, school building, etc.) that corresponds to a particular classroom within which user device 110 is to be located, at the current time, based on the personnel information.

If, for example, the attendance application identifies that user device 110 is located in the particular classroom, then the attendance application may determine that the user, of user device 110, is present. If the attendance application determines that user device 110 is not located in the particular classroom, then the attendance application may determine that user device 110 is not present. The attendance application may identify, at a later point in time (e.g., after a particular period starts and before the particular period ends), that user device 110 is located within the particular classroom, and may determine that the user is present, but is tardy. The attendance application may identify, at another later point in time (e.g., after the particular period ends), that user device 110 is not located within the particular classroom, and may determine that the user is not present and is absent.

In another example, the attendance application may, based on the location information, determine whether user device 110 is located within an authorized geographic area (e.g., corresponding to a bus route between home and a school with which user device 110 is associated, etc.). The geographic area may be specified, by the parent of a user of user device 110, as a set of boundaries outside which user device 110 is not authorized to be located. In yet another example, the attendance application may, based on the location information, determine a rate at which user device 110 changes location (e.g., speed, velocity, acceleration, etc.). Attendance application may, for example, determine whether user device 110 is adhering to posted speed limits (e.g., whether a speed, associated with user device 110, is greater than a threshold, such as when the user is commuting to or from a school, work place, etc.) and/or whether user device 110 was involved in an accident (e.g., when a rate at which a speed, corresponding to user device 110 changes, such as during a deceleration or acceleration, exceeds a threshold).

Based on the determination that the user is tardy and/or absent, the attendance application may determine, from the personnel information, whether the tardiness and/or absence was excused. The tardiness and/or absence may be excused based on information stored in the personnel information that indicates that the tardiness and/or absence is excused. The information may be stored in the personnel information based on, for example, a notification received from another user device 110 (e.g., with which a parent and/or doctor of the user is associated) and/or when the information is stored in the personnel information by an operator of client device 120 (e.g., when the absence is approved by a teacher, supervisor, etc.). In an example where the absence is not excused, the attendance application may send a notification to user device 110 and/or to the other user device 110 (e.g., with which the parent is associated) identifying that user device 110 is absent and is not excused. In another example, the attendance application may send the notification to the other user device 110 and may receive a response from the other user device 110 indicating that the absence was not authorized. Based on the indication that the absence was not authorized, the attendance application may perform an operation to locate user device 110. In one example, the attendance application may send an absence notification, associated with user device 110, to client device 120 (e.g., with which a truant officer, police officer, etc. is associated) that indicates that the whereabouts of user device 110 are to be determined. In another example, the attendance application may send a query to SGW server 140 to obtain location information associated with user device 110. If the location of user device 110 cannot be determined and/or is determined to be at an unauthorized location (e.g., a location that corresponds to another county, another state, outside an authorized boundary, a distance from a school that is greater than a threshold, etc.), then the attendance application may send an event notification to public server 130 (e.g., associated with local, state, and/or federal authorities and/or first responders) indicating that user device 110 (e.g., the user of user device) is missing and/or is at an unauthorized location. The event notification may include the location information that enables a parent and/or the first responders and/or or other governmental authorities to locate user device 110 based on the location information.

The attendance application may store and/or update a status of user device 110 in the personnel information. For example, the attendance application may store a present status of user device 110 in the personnel information. The attendance application may update the personnel information associated with a period of time (e.g., a quantity of yearly absences, a quantity of times that user device 110 was tardy, etc.). The attendance application may update classroom rosters based on a quantity of present and/or absent user devices 110 and may send recommended curriculum changes and/or tasking to client device 120 (e.g., with which a teacher and/or supervisor, respectively, are associated).

The attendance application may perform operations in response to the occurrence of some event and/or that are tailored to the demographics of a particular day and/or time. For example, the attendance application may send notifications to user devices 110 and/or client devices 120 alerting users of user devices 110 and/or operators of client devices 120 of the occurrence of some event (e.g., an unplanned office and/or school closing due to inclement weather, etc.). The attendance application may identify whether particular operators of client device 120 are present to determine whether a quorum exists in order to schedule a meeting. Based on a determination regarding whether the quorum exists, the attendance application may send a notification that the meeting is going to be held (e.g., when the quorum is determined to exist) or that the meeting is not going to be held (e.g., when the quorum is determined not to exist). The attendance application may determine a quantity of user devices 110 that are present and/or absent and may recommend adjustments to a curriculum, reassignment of tasks, changes to a schedule based on which users, of user devices 110, are present.

Network 160 may include one or more wired and/or wireless networks. For example, network 160 may include a cellular network, the public land mobile network (PLMN), a second generation (2G) network, a third generation (3G) network, a fourth generation (4G) network (e.g., a long term evolution (LTE) network), a fifth generation (5G) network, and/or another network. Additionally, or alternatively, network 160 may include a wide area network (WAN), a metropolitan area network (MAN), a telephone network (e.g., the Public Switched Telephone Network (PSTN)), an ad hoc network, an intranet, the Internet, a fiber optic-based network (e.g., a FiOS network), and/or a combination of these or other types of networks.

Figure 2:
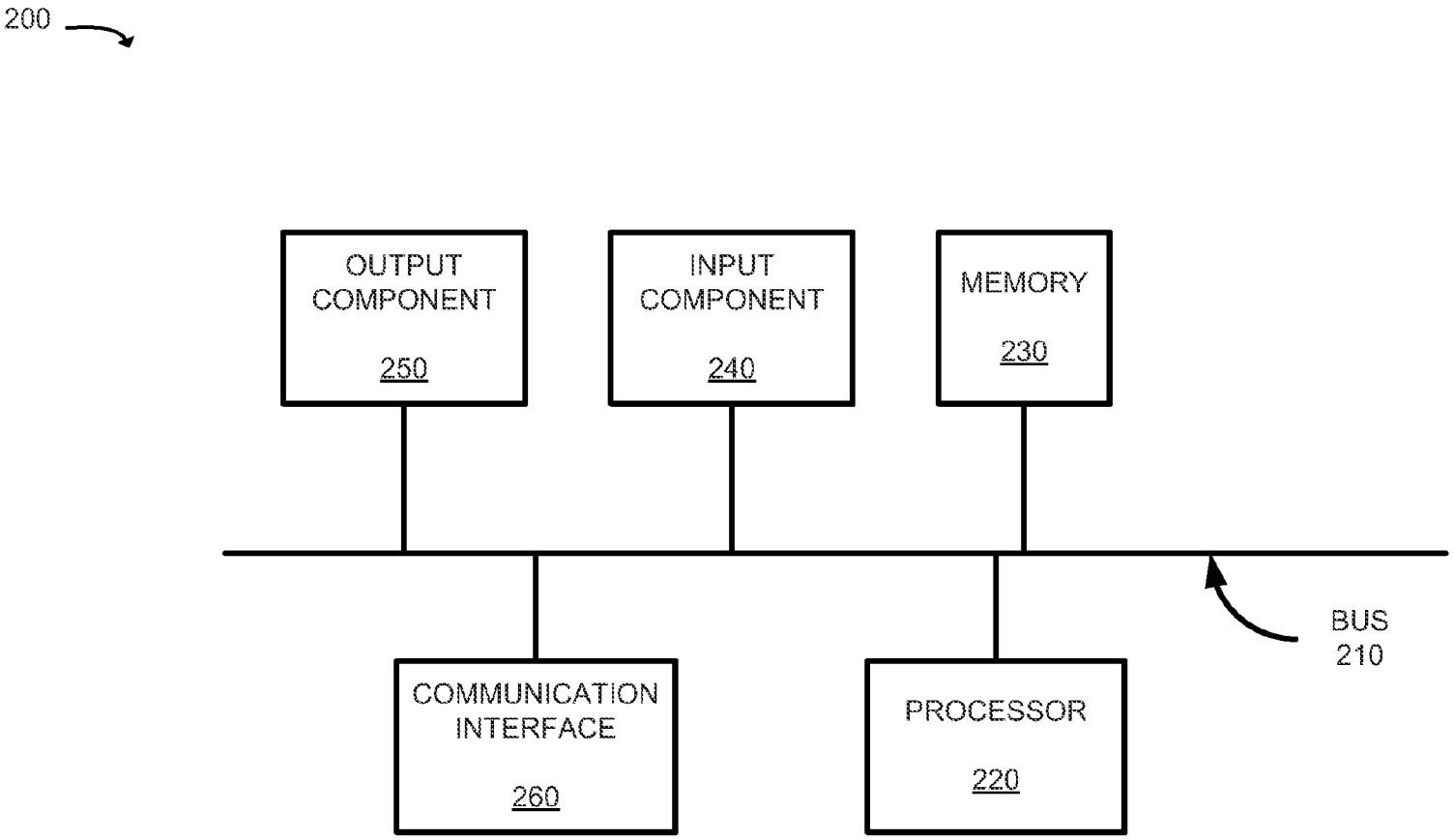
FIG. 2 is a diagram of example components of one or more of the devices of FIG. 1.

FIG. 2 is a diagram of example components of a device 200. Device 200 may correspond to user device 110, client device 120, public server 130, SGW server 140, and/or application server 150. Alternatively, each of user device 110, client device 120, public server 130, SGW server 140, and/or application server 150 may include multiple devices 200 or multiple components of device 200.

Device 200 may include a bus 210, a processor 220, a memory 230, an input component 240, an output component 250, and a communication interface 260. Although FIG. 2 shows example components of device 200, in other implementations, device 200 may contain fewer components, additional components, different components, or differently arranged components than depicted in FIG. 2. Additionally, or alternatively, one or more components of device 200 may perform one or more tasks described as being performed by one or more other components of device 200.

Bus 210 may include a path that permits communication among the components of device 200. Processor 220 may include a processor, microprocessor, or processing logic that may interpret and execute instructions. Memory 230 may include any type of dynamic storage device that may store information and instructions, for execution by processor 220, and/or any type of non-volatile storage device that may store information for use by processor 220.

Input component 240 may include a mechanism that permits a user to input information to device 200, such as a keyboard, a keypad, a button, a switch, a microphone, a camera, a fingerprint reader, etc. Output component 250 may include a mechanism that outputs information to the user, such as a display, a speaker, one or more light emitting diodes (LEDs), a haptics-based device, etc. Communication interface 260 may include any transceiver-like mechanism that enables device 200 to communicate with other devices and/or systems via wireless communications (e.g., radio frequency, infrared, and/or visual optics, etc.), wired communications (e.g., conductive wire, twisted pair cable, coaxial cable, transmission line, fiber optic cable, and/or waveguide, etc.), or a combination of wireless and wired communications. For example, communication interface 260 may include mechanisms for communicating with another device or system via a network, such as network 160.

As will be described in detail below, device 200 may perform certain operations relating to automated attendance tracking and/or event notification operations. Device 200 may perform these operations in response to processor 220 executing software instructions contained in a computer-readable medium, such as memory 230. A computer-readable medium may be defined as a non-transitory memory device. A memory device may include space within a single physical memory device or spread across multiple physical memory devices. The software instructions may be read into memory 230 from another computer-readable medium or from another device. The software instructions contained in memory 230 may cause processor 220 to perform processes described herein. Alternatively, hardwired circuitry may be used in place of or in combination with software instructions to implement processes described herein. Thus, implementations described herein are not limited to any specific combination of hardware circuitry and software.

FIG. 3 is a diagram of an example personnel account set up data structure 300 (hereinafter referred to as "set up data structure 300") according to an implementation described herein. Set up data structure 300 is described in the context of a student account that is associated with a user of user device 110. In another example implementation, set up data structure 300 may be associated with a context other than a student account (e.g., an employee account, etc.) that is associated with the user of user device 110. As illustrated in FIG. 3, set up data structure 300 may include a collection of fields, such as a user identifier (ID) field 302, a user information (info) field 304, a user device information (info) field 305, a morning transportation (TRANS) field 306, a set of period fields 308-1, . . . , 308-P (where P≥1), an afternoon transportation (TRANS) field 310, a special needs field 312, a medication field 314, an authorized pick up field 316, and a set of parent information fields 318-1-318-2. Set up data structure 300, of FIG. 3, includes fields 302-318 for explanatory purposes. In practice, set up data structure 300, of FIG. 3, may include additional fields, fewer fields, different fields, and/or differently arranged fields than are described with respect to context data structure 300 of FIG. 3.

User ID field 302 may store a name, a student ID number, etc. associated with a user of a particular user device 110. User info field 304 may store information associated with the user. For example, the attendance application may store, in user info field 304, an age, a grade level, a sex, physical characteristics (e.g., hair color, eye color, height, weight, race, etc.) associated with the user. User device info field 305 may store information associated with the particular user device 110 with which the user is associated. For example, the attendance application may store, in user device info field 305, the information associated with the particular user device 110, which may include a device identifier (e.g., MDN, SIM URI, etc.), an address (e.g., an IP address, a MAC address, etc.), a type of device (e.g., a cellular telephone, a PDA, etc.).

Morning trans field 306 may store information associated with a mode of transportation used by the user of the particular user device 110 when commuting to school. For example, the attendance application may store, in morning trans field 306, information associated with a bus number, a bus schedule, a bus route, a bus stop, a period of time during which the particular user device 110 is scheduled to be commuting, an indication that the particular user device 110 is driven to school, information associated with a vehicle via which the particular user device 110 is driven to school, etc. Period fields 308-1 through 308-P may store information associated with a location at which the particular user device 110 is to be located during each period (e.g., period 1-period P) identified by period fields 308-1 through 308-P. For example, the attendance application may store, in period fields 308-1 through 308-P, a room number, a location (e.g., coordinates, latitude/longitude, etc.), a position within a facility, an address, etc. for each of the periods that the particular user device 110 is scheduled to be located.

Afternoon trans field 310 may store information associated with a mode of transportation used by the particular user device 110 when commuting from school to home or some other location. Special needs field 312 may store information associated with special needs of the user. For example, the attendance application may store, in special needs field 312, information regarding an illness, condition, allergy, and/or handicap associated with the user. The information associated with special needs may be used by a doctor in the event of a medical emergency or by a law enforcement officer, a teacher, etc. when performing an operation to locate, communicate and/or treat the user. Medication field 314 may identify a medication that the user is authorized to take.

Authorized pick up field 316 may store information that identifies persons that are authorized, by parents of the user, to pick up the user from school. Parent information fields 318-1 and 318-2 may store information associated with the parent of the user. For example, the attendance application may store, in parent information fields 318, information associated with one or more parents associated with the user (e.g., a username, password, PIN, a street address, a telephone number, etc.), information associated with another user device 110 via which the parent communicates with application server 150, etc.

Application server 150 may receive a request, from the particular user device 110 and/or the other user device 110 (e.g., with which the parent is associated) to set up an account associated with a student (e.g., the user of the particular user device 110). The attendance application may, in response to the request, send information associated with a set up user interface (UI) that permits the user, or parent of the user, to enter personnel information, associated with the user, via the set up UI. The user, or parent of the user, may enter the personnel information into the set up UI, which may enable the personnel information to be sent to application server 150. Application server 150 may receive the personnel information and may store the personnel information in a set up data structure (e.g., set up data structure 300).

For example, the stored personnel information may include a name and/or student ID associated with the user (e.g., Chuck Brown and/or 1234, respectively), information associated with the user (e.g., age 6, male, 1$^{st}$ grade, and any physical traits associated with the user), and/or information associated with the particular user device 110 (e.g., MDN1) (e.g., as shown by ellipse 320). The stored personnel information may also include information associated with a mode of transportation via which the user commutes to school (e.g., bus ID: 113, a duration of the commute "07:15-07:55"), information associated with locations at which the particular user device 110 is to be during each period of the day (e.g., period 1-Rm1; period 2-Rm3; period 3-gym, etc.) and/or information associated with a mode of transportation via which the user commutes from school (e.g., bus ID: 121, a duration of the commute "15:15-15:50") (e.g., as shown by ellipse 320). In one example implementation, the information associated with the mode of transportation via which the user commutes to and/or from school and/or the information associated with the locations at which the particular user device 110 is to be located during each period of the day may be retrieved from a memory associated with application server 150 (e.g., in response to the request to set up the account) and may be sent to user device 110 for display (e.g., pre-populated) via the set up UI.

The stored personnel information may further include information associated with special needs of the user (e.g., condition A, allergy B, etc.), information associated with a medication to be taken (e.g., medication A at 1:00 pm), and/or information associated with persons that are authorized, by the parent, to pick up the user (e.g., Mr. or Mrs. Michael Brady) (e.g., as shown by ellipse 320). The stored personnel information may still further include information associated with a parent of the user (e.g., a username, password, PIN, address, telephone number, etc.) and/or information associated with another user device 110 via which the parent communicates with the attendance application (e.g., MDN2) (e.g., as shown by ellipse 320).

Figure 4:
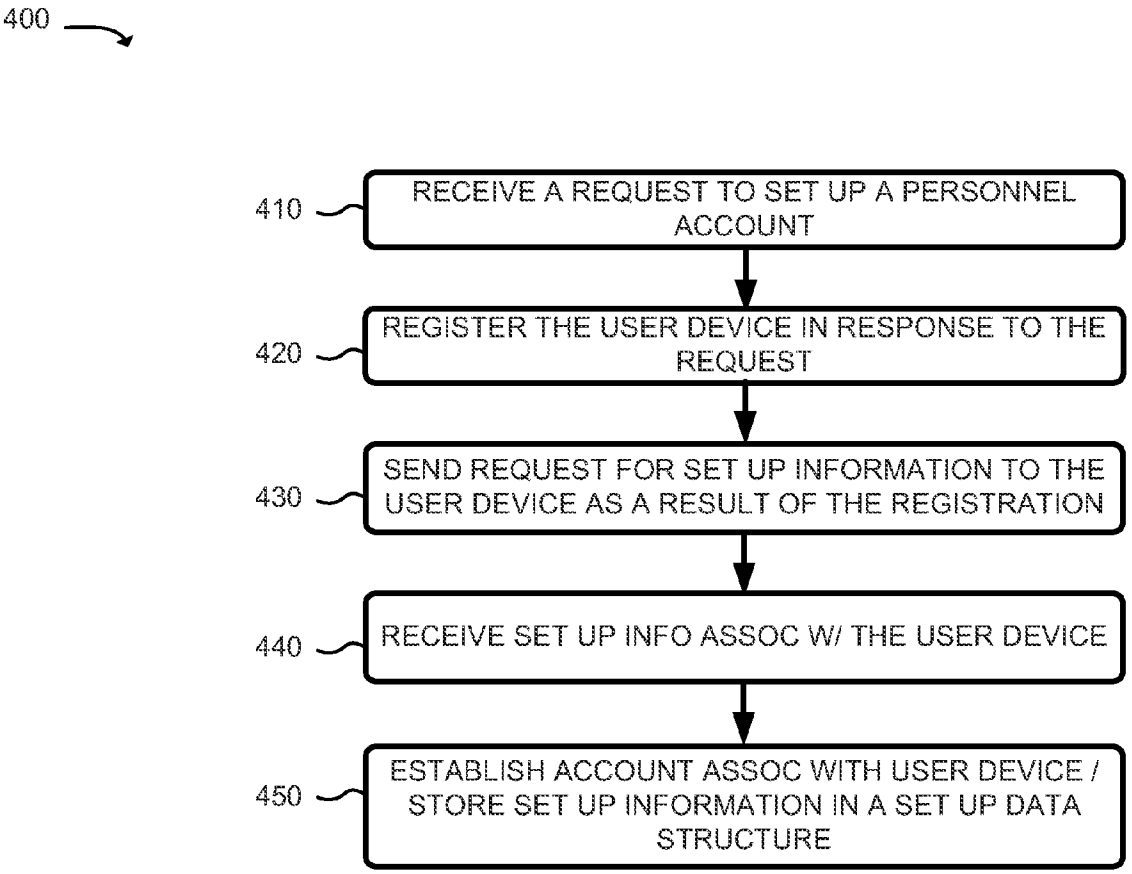
FIG. 4 is a flow chart of an example process for setting up a personnel account according to an implementation described herein.

FIG. 4 is a flow chart of an example process 400 for setting up a personnel account to be used to perform an automatic attendance tracking and/or event notification operation according to an implementation described herein. In one implementation, process 400 may be performed by application server 150. In another implementation, some or all of process 400 may be performed by a device or collection of devices separate from, or in combination with, application server 150.

As shown in FIG. 4, process 400 may include receiving a request to set up a personnel account associated with a user of a user device 110 (block 410) and registering user device 110 in response to the request (block 420). For example, a user (or a parent of the user), of user device 110, may send a request, to application server 150 and via SGW server 140, to set up a personnel account associated with user device 110. Application server 150 may receive the request and an attendance application, hosted by application server 150, may perform an operation to register user device 110. For example, the attendance application may compare information associated with user device 110 to other information associated with user device 110 stored in a memory associated with application server 150. Based on a determination that information associated with user device 110 matches the stored information associated with user device 110, the attendance application may authenticate user device 110 and may send a request, to user device 110 (e.g., via SGW server 140), for registration information associated with the user (e.g., username, password, PIN, street address, telephone number, etc.). The attendance application may receive, from user device 110, the registration information and may register user device 110. If the attendance application is not able to authenticate user device 110 (e.g., when the information associated with user device 110 does not match stored information associated with user device 110), then the attendance application may not register user device 110.

As also shown in FIG. 4, process 400 may include sending a request for personnel information as a result of the registration operation (block 430) and receiving the personnel information associated with a user of the registered user device 110 (block 440). For example, the attendance application may, as a result of registering user device 110, retrieve information associated with a set up UI from a memory associated with application server 150. The attendance application may send, via SGW server 140, the information associated with the set up UI to user device 110 to be displayed on user device 110. The user, or parent of the user, may enter the personnel information into the set up UI and application server 150 may receive the personnel information, via the set up UI.

In an example implementation, the attendance application may send, to client device 120 (e.g., with which a school administrator is associated), a request for a class schedule and/or bus information associated with the user of user device 110. The information associated with the class schedule and/or bus information may correspond to the information associated with the mode of transportation via which the user commutes to and/or from school and/or the information associated with the locations at which the particular user device 110 is to be located during each period of the day (e.g., fields 306-310 of FIG. 3). The attendance application may receive the information and may send the information to user device 110 (e.g., by pre-populating a portion of the set up UI).

As further shown in FIG. 4, process 400 may include establishing an account associated with user device 110 and storing the personnel information in a set up data structure (block 450). For example, the attendance application may establish an account associated with user device 110 based on the registration of user device 110 and/or the receipt of all or a portion of the personnel information associated with user device 110. Additionally, or alternatively, the attendance application may use the personnel information to generate other data structures. For example, the attendance application may generate a roster data structure for each client device 120 based on personnel information obtained from users of other user devices 110. In another example, the attendance application may generate a master roster that includes all or a portion of the personnel information that corresponds to the users of other user devices 110 and/or information associated with operators of client devices 120 that communicate with SGW server 140.

The attendance application may send a notification to user device 110 requesting that a parent and/or guardian of the user of user device 110 authorize the collection and/or use of location information, associated with the user device 110, when performing automated attendance tracking and/or event notification operations. The request may be accompanied with information describing the information, associated with user device 110, that is to be collected (e.g., information associated with the location of user device 110, changes in the location of user device 110 as a function of time, set up information as described above, etc.) and/or a manner in which the collected information is to be used and/or disseminated.

FIG. 5A is a diagram of an example personnel data structure 500 according to an implementation described herein. Personnel data structure 500 is described as being associated with a school and/or education-oriented organization. In another example implementation, personnel data structure 500 may be associated with an organization other than a school, such as a business, an association, etc. As illustrated in FIG. 5A, personnel data structure 500 may include a collection of fields, such as a user identifier (ID) field 502, a user information (info) field 504, a user device information (info) field 506, a current period indicator field 508, an assigned location field 510, a presence indicator field 512, a location indicator field 514, a time in field 516, a time out field 518, a status field 520, and a notification field 522. Personnel data structure 500, of FIG. 5A, includes fields 502-522 for explanatory purposes. In practice, personnel data structure 500, of FIG. 5A, may include additional fields, fewer fields, different fields, and/or differently arranged fields than are described with respect to personnel data structure 500 of FIG. 5A.

User ID field 502 may store a name and/or a student ID number that corresponds to a user of user device 110. User info field 504 may store information associated with the user. For example, the attendance application may store, in user info field 504, an age, a grade level, a sex, physical characteristics (e.g., hair color, eye color, height, weight, race, etc.) associated with the user. User device info field 506 may store information associated with user device 110 with which the user is associated. For example, the attendance application may store, in device info field 506, information associated with user device 110, which may include a device identifier (e.g., MDN, SIM URI, etc.), an address (e.g., an IP address, a MAC address, etc.), a type of device (e.g., laptop computer, a cellular telephone, a PDA, etc.).

Current period indicator field 508 may store information associated with a period (e.g., a school period) at a current point in time. Assigned location field 510 may store information associated with a location at which the user is assigned during a current period identified in current period indicator field 508. Presence indicator field 512 may store an indicator of whether the user is located at the assigned location. For example, if the user is located at the assigned location, then the attendance application may store an indication that the user is present. If the user is not located at the assigned location, then the attendance application may store an indication that the user is not present. Location indicator field 514 may store an indicator that corresponds to an actual location of user device 110. For example, if user device 110 is located at a location that corresponds to the assigned location, then the attendance application may store a location indicator that matches the assigned location indicator. If user device 110 is not located at a location that corresponds to the assigned location, then the attendance application may store a location indicator that does not match the assigned location indicator.

Time in field 516 may store a time at which user device 110 entered the assigned location. For example, the attendance application may use location information, obtained from SGW server 140, to identify a time at which the location information matched the assigned location. In another example implementation, user device 110 may send a signal to application server 150 indicating that user device 110 is located at the assigned location. For example, the user device 110 may send a signal (e.g., a Bluetooth signal, a beamed infrared signal) to client device 120 and/or to application server 150 when user device 110 is located at the assigned location (e.g., when user device 110 enters a room that corresponds to the assigned location). In yet another example implementation, the user may cause user device 110 to scan a device (e.g., an RFID device) located at the assigned location and which includes a unique code associated with the assigned location. User device 110 may send a signal (e.g., that includes the unique code) to application server 150 indicating that user device 110 is at the assigned location.

Time out field 518 may store a time at which user device 110 exits the assigned location. For example, the attendance application may use location information, obtained from SGW server 140, to identify another time at which the location information does not match the assigned location. In another example implementation, user device 110 may send a signal to application server 150 indicating that user device 110 is not located at the assigned location. For example, the user device 110 may cease sending a signal (e.g., a Bluetooth signal, a beamed infrared signal) to client device 120 and/or to application server 150 when user device 110 is not located at the assigned location (e.g., when user device 110 leaves the room that corresponds to the assigned location). In another example, user device 110 may send another signal to another client device 120 and/or to application server 150 when the user is located at another location that does not match the assigned location. In yet another example implementation, the user may cause user device 110 to scan a device (e.g., an RFID device) located at the assigned location and which includes a unique code associated with the assigned location. User device 110 may send a signal (e.g., that includes the unique code) to application server 150 indicating that user device 110 is leaving the assigned location. In another example, the user may cause user device 110 to scan another device (e.g., another RFID device) located at another location which indicates that user device 110 is not located at the assigned location.

Status field 520 may store an indication of whether user device 110 is associated with a normal state, a late state, and/or an absent state. For example, the attendance application may store a normal indication when user device 110 is present at the assigned location and/or arrived at the assigned location on time (e.g., prior to a time at which the current period begins). In another example, the attendance application may store a late indication when user device 110 is present at the assigned location and/or arrived at the assigned location late (e.g., after the time at which the current period begins). In yet another example, the attendance application may store an absent indication when user device 110 is not present at the assigned location.

Notification field 522 may store an indication that a notification is to be sent based on a state associated with user device 110. For example, the attendance application may store an indication that an absent notification is to be sent when user device 110 is absent and the absence is not excused. In another example, the attendance application may store an indication that a tardy notification is to be sent when user device 110 is determined to be late and the lateness is not excused.

Application server 150 may receive location information associated with user device 110 and the attendance application may identify a state associated with user device 110. For example, the attendance application may retrieve information from a set up data structure (e.g., set up data structure 300 of FIG. 3) associated user device 110 and may store the information in personnel data structure 500. The information may include an identifier associated with the user of user device 110 (e.g., Chuck Brown), user information (e.g., age 6, 1$^{st}$ grade), information associated with user device 110 (e.g., MDN1), and/or an assigned location (e.g., RM2) that corresponds to a current period (e.g., 1) (e.g., as shown by ellipse 524). The attendance application may determine, from the location information associated with user device 110, that a location associated with user device 110 (e.g., RM2) matches the assigned location (e.g., RM2) (e.g., as shown by ellipse 524). The attendance application may store a presence indicator (e.g., present) based on the determination that the location of user device 110 matches the assigned location (e.g., as shown by ellipse 524). The attendance application may identify a time at which user device 110 entered the assigned location (e.g., 8:58 am) and may determine a status associated with user device 110 (e.g., on time) when the time is prior to a start time associated with the current period (e.g., as shown by ellipse 524). Based on the determination that user device 110 was determined to be present at the assigned location for the current period and was on time, the attendance application may store an indication (e.g., none) that a notification, associated with user device 110 is not to be sent (e.g., as shown by ellipse 524).

Application server 150 may receive location information associated with other user devices 110 and the attendance application may identify a state associated with each of the other user devices 110. For example, the attendance application may retrieve information from a set up data structure (e.g., set up data structure 300 of FIG. 3) associated with each of the other user devices 110 and may store the information in personnel data structure 500 (e.g., shown as ellipses 526-530). The attendance application may determine, from the location information associated with another user device 110, of the other user devices 110, that a location associated with the other user device 110 (e.g., RM3) matches the assigned location (e.g., RM3) (e.g., as shown by ellipse 526). The attendance application may store a presence indicator (e.g., present) based on the determination that the location of the other user device 110 matches the assigned location (e.g., as shown by ellipse 526). The attendance application may identify a time at which the other user device 110 entered the assigned location (e.g., 9:12 am) and may determine a status associated with the other user device 110 (e.g., late) when the time is after a start time associated with the current period (e.g., as shown by ellipse 526). Based on the determination that the other user device 110 was determined to be present at the assigned location for the current period and was late, the attendance application may store an indication (e.g., tardy) that a tardy notification, associated with the other user device 110 is to be sent (e.g., as shown by ellipse 526).

In yet another example, the attendance application may determine that a location (e.g., LOC1) associated with a further user device 110 does not match the assigned location (e.g., RM3) (e.g., as shown by ellipse 528). The attendance application may store a presence indicator (e.g., not present) based on the determination that the location of the other user device 110 does not match the assigned location (e.g., as shown by ellipse 528). The attendance application may store a status (e.g., absent) associated with the further user device 110 and may store an indication (e.g., absent) that an absent notification, associated with the further user device 110, is to be sent (e.g., as shown by ellipse 528).

In still another example, the attendance application may determine a status (e.g., absent) associated with another user device 110 (e.g., as shown by ellipse 530). The attendance application may determine that the absence is excused based on a notification received from client device 120 (e.g., when an operator, such as a teacher, authorized an early departure from an assigned location). Based on the determination that the absence is excused, the attendance application may store an indication (e.g., excused) that an absence excused notification, associated with the other user device 110, is to be sent (e.g., as shown by ellipse 530).

Figure 5B:
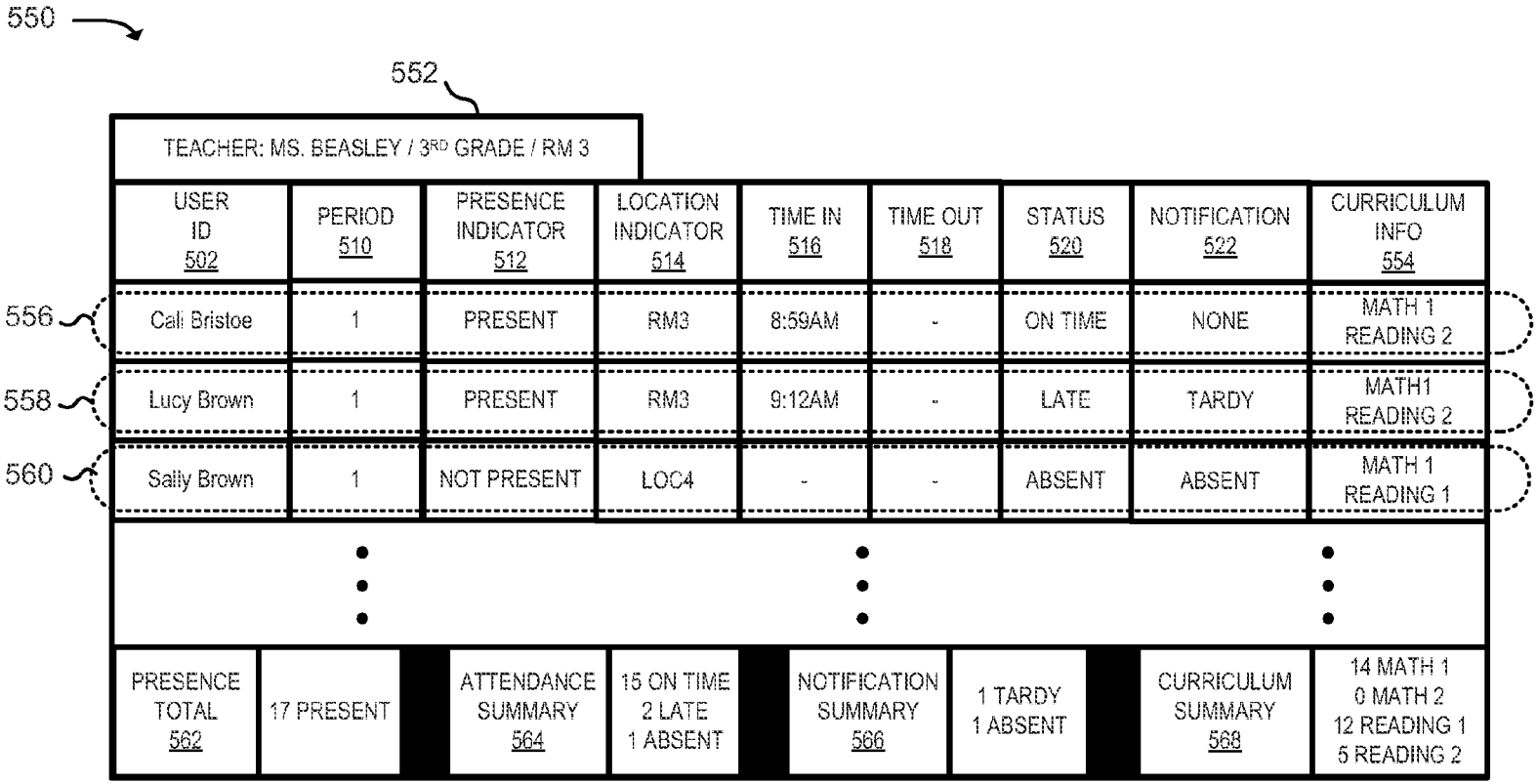

FIG. 5B is a diagram of an example roster data structure 550 according to an implementation described herein. Roster data structure 550 is described as being associated with a school and/or education-oriented organization. In another example implementation, roster data structure 550 may be associated with an organization other than a school, such as a business, an association, etc. As illustrated in FIG. 5B, roster data structure 550 may include a collection of fields, such as fields 502 and 510-522 of personnel data structure 500 (FIG. 5A), a roster identifier field 552, a curriculum information field 554, a presence total field 562, an attendance summary field 564, a notification summary field 566, and a curriculum summary field 568. Roster data structure 550, of FIG. 5B, includes fields 502, 510-522, and 554-568 for explanatory purposes. In practice, roster data structure 550, of FIG. 5B, may include additional fields, fewer fields, different fields, and/or differently arranged fields than are described with respect to roster data structure 550 of FIG. 5B.

Roster identifier field 552 may store information associated with an operator of client device 120 to which roster data structure 550 corresponds. For example, the information associated with the operator (e.g., Ms. Beasley, 3$^{rd}$ Grade, RM 3) may be associated with roster data structure 550. Curriculum information field 554 may store information associated with a curriculum that corresponds to a user of user device 110. Presence total field 562 may store a quantity of users of user device 110 that are identified as present (e.g., by presence indicator 512). Attendance summary field 564 may store a summary of status indicators stored in status field 520. Notification summary field 566 may store a summary of notification indicators stored in notification field 522. Curriculum summary field 568 may store a summary of curriculum information stored in curriculum information field 554.

The attendance application may generate one or more roster data structures 550 for all or a portion of the operators associated with client devices 120. Roster data structure 550 may, in a manner similar to that described above (e.g., with respect to personnel data structure 500 of FIG. 5A), may store information regarding whether a user, of user device 110, is present or not present; is on time, is late, or is absent; and/or whether and/or what type of a notification is to be sent (e.g., none, tardy, absent, excused, etc.) (e.g., as shown by ellipses 556-560).

The attendance application may determine a total quantity of user devices 110 that are present at the assigned location (e.g., based on indicators stored in presence indicator field 512) and may store the total quantity in data structure 550 (e.g., shown as 17 present in presence total field 562). The attendance application may identify an attendance summary (e.g., based on the status indicators stored in status field 520) and may store the summary in roster data structure 550 (e.g., shown as 15 on time, 2 late, and 1 absent in attendance summary field 564). The attendance application may identify a notification summary (e.g., based on the notification indicators stored in notification field 522) and may store the notification summary in roster data structure 550 (e.g., shown as 1 tardy and 1 absent in notification summary field 566).

The attendance application may identify a curriculum summary (e.g., based on the curriculum information, that corresponds to user devices 110, stored in curriculum info field 554) and may store the curriculum summary in roster data structure 550 (e.g., shown as 14 math 1, 0 math 2, 12 reading 1, and 5 reading 2 in curriculum summary field 568). An operator may use the information stored in roster data structure 550 to tailor curricula based on the quantity of user devices 110 that are present and/or the curriculums associated with the user devices 110 that are present. For example, an operator of client device 120 may tailor a math curriculum based on a determination that no user devices 110 associated with the math 2 curricula are present. In another example, the attendance application may, over a period of time, determine whether absenteeism and/or tardiness (e.g., based on notification summary field 566), associated with a class with which roster data structure 550 is associated, is excessive (e.g., based on a threshold) and may send a notification if excessive absenteeism and/or tardiness is detected.

Figure 6A:
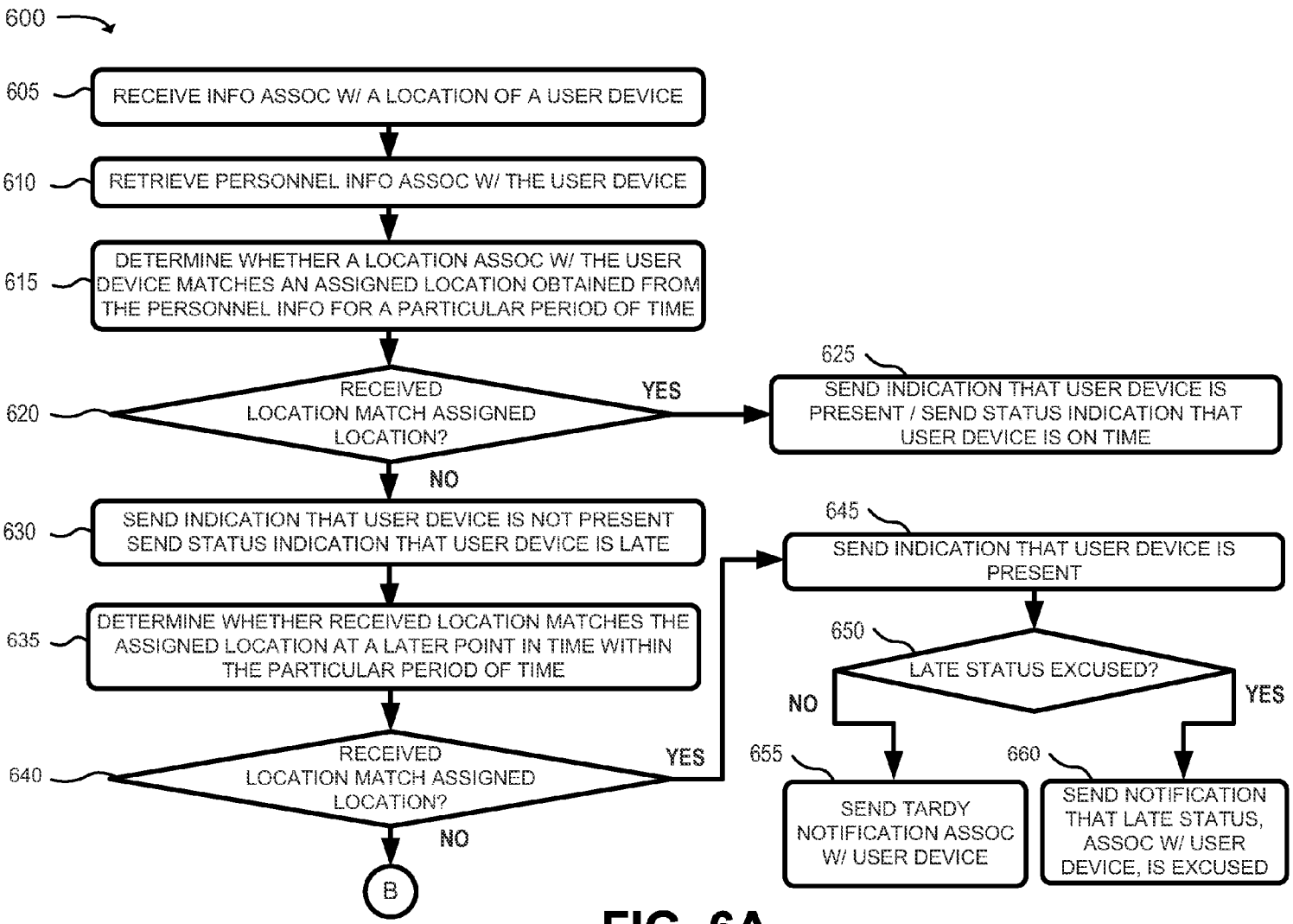
FIGS. 6A and 6B are flow charts of an example process for performing an automated personnel attendance tracking and/or event notification operation according to an implementation described herein.
Figure 6B:
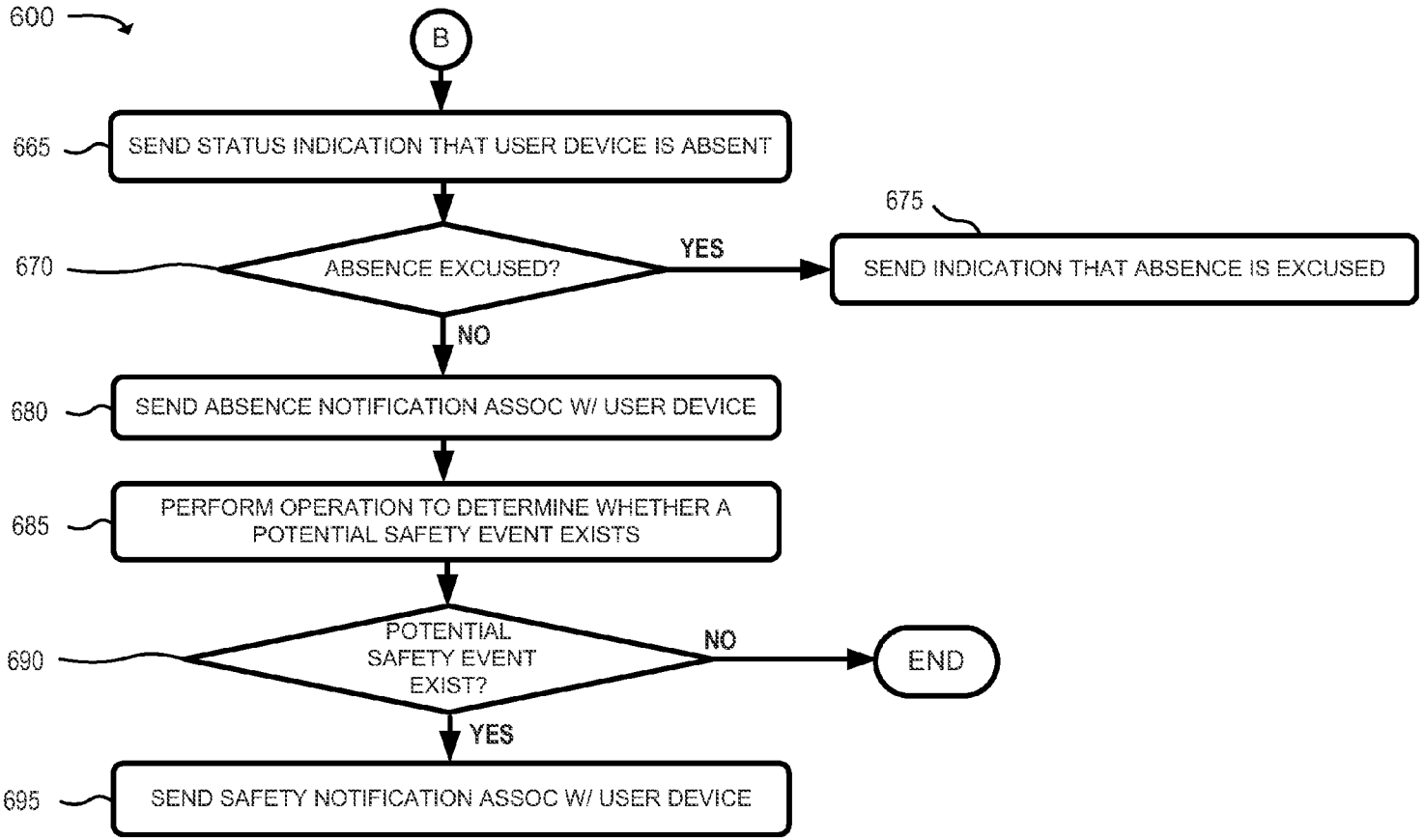

FIGS. 6A and 6B are flow charts of an example process 600 for performing an automated personnel attendance tracking and/or event notification operation according to an implementation described herein. In one implementation, process 600 may be performed by application server 150. In another implementation, some or all of process 600 may be performed by a device or collection of devices separate from, or in combination with, application server 150.

As shown in FIG. 6A, process 600 may include receiving information associated with a location of user device 110 (block 605) and retrieving personnel information associated with user device 110 (block 610). For example, SGW server 140 may receive location information associated with user device 110 and may send the location information to application server 150. Application server 150 may receive the location information and may use an attendance application (e.g., hosted by application server 150) to retrieve, from a memory associated with application server 150, personnel information (e.g., from personnel data structure 500 of FIG. 5A) associated with user device 110. In another example implementation, the attendance application may retrieve roster information (e.g., from roster data structure 550 of FIG. 5B) associated with a group (e.g., a class, a team, a labor force, etc.) with which user device 110 is associated and/or with a location at which user device 110 is scheduled to be located.

As also shown in FIG. 6A, process 600 may include determining whether a location, associated with user device 110, matches an assigned location, obtained from the personnel information, for a particular period of time (block 615). For example, the attendance application may use the personnel information (and/or the roster information) to determine an assigned location, associated with user device 110, for a particular period of time (e.g., a period during a school day, a work shift, etc.). The attendance application may compare the received location (e.g., received from SGW server 140), associated with user device 110, to the assigned location to determine whether user device 110 is located at the assigned location (e.g., to determine whether the received location matches the assigned location).

As further shown in FIG. 6A, if the received location matches the assigned location (block 620—YES), then process 600 may include sending an indication that user device 110 is present and sending a status indication that user device 110 is on time (block 625). For example, the attendance application may determine, based on the comparison, that the received location matches the assigned location. Based on the determination that that received location matches the assigned location, the attendance application may store, in the personnel data structure, an indication that user device 110 is present. The attendance application may determine, based on the location information, that user device 110 was located at the assigned location at a time when the particular period of time started and may store, in the personnel data structure, a status indication that user device 110 is on time. Additionally, or alternatively, the attendance application may send the indication and/or the status indication to another user device 110 (e.g., associated with a parent, guardian, spouse, etc. of a user of user device 110) and/or client device 120 (e.g., that corresponds to an operator, such as a teacher, a supervisor, etc.) that is associated with the group with which user device 110 is associated and/or that corresponds to the assigned location. Client device 120 may receive the indication and/or status indication and may update a roster data structure based on the indication and/or the status indication.

As yet further shown in FIG. 6A, if the retrieved location does not match the assigned location (block 620—NO), then process 600 may include sending an indication that user device 110 is not present and sending a status indication that user device 110 is late (block 630). For example, the attendance application may determine, based on the comparison, that the received location does not match the assigned location at a time when the particular period of time started. Based on the determination that that received location does not match the assigned location, the attendance application may store, in the personnel data structure, an indication that user device 110 is not present and/or may store, in the personnel data structure, a status indication that user device 110 is late. Additionally, or alternatively, the attendance application may send the indication and/or the status indication to the other user device 110 and/or client device 120 that is associated with the group with which user device 110 is associated and/or that corresponds to the assigned location. Client device 120 may receive the indication and/or status indication and may update a roster data structure based on the indication and/or the status indication.

As still further shown in FIG. 6A, process 600 may include determining whether a location associated with user device 110 matches the assigned location at a later point in time within the particular period of time (block 635). For example, application server 150 may receive, from SGW server 140, updated location information associated with user device 110 at a later point in time that is within the particular period of time. The attendance application may, in a manner similar to that described above (e.g., with respect to block 615), compare an updated location with the assigned location.

As shown in FIG. 6A, if the retrieved location matches the assigned location (block 640—YES), then process 600 may include sending an indication that user device 110 is present (block 645). For example, the attendance application may determine, based on the comparison, that the updated location matches the assigned location at the later point in time. Based on the determination that the updated location matches the assigned location, the attendance application may store, in the personnel data structure, an indication that user device 110 is present. Additionally, or alternatively, the attendance application may send the indication to the other user device 110 and/or client device 120 that is associated with the group with which user device 110 is associated and/or that is associated with the assigned location. Client device 120 may receive the indication and may update a roster data structure based on the indication.

As also shown in FIG. 6A, if the late status is not excused (block 650—NO), then process 600 may include sending a tardy notification associated with user device 110 (block 655). For example, the attendance application may determine whether the late status, associated with user device 110, is excused based on information obtained from the personnel data structure and/or the roster data structure. If the information obtained from the personnel and/or roster data structure does not indicate that the late status is excused, then the attendance application may determine that user device 110 is tardy. Based on the determination that user device 110 is tardy, the attendance application may store, in the personnel data structure and/or roster data structure, an indication that user device 110 is tardy and/or may send a tardy notification to user device 110 and/or the other user device 110. Additionally, or alternatively, the attendance application may send the indication to client device 120 that is associated with the group with which user device 110 is associated and/or that corresponds to the assigned location.

In an example implementation, the attendance application may retrieve, from the personnel data structure, information associated with a quantity of times that user device 110 was identified as being tardy over a time period (e.g., a school year, a quarter, a semester, etc.). The attendance application may compare the quantity of times that user device 110 was identified as being tardy to a threshold to determine whether a tardy condition (e.g., corresponding to excessive tardiness), associated with user device 110, exists. Based on a determination that the quantity of times that user device 110 was identified as being tardy, is greater than the threshold, the attendance application may send a notification to user device 110 and/or the other user device 110 and/or may store, in the personnel data structure, information associated with the tardiness condition with which user device 110 is associated.

As further shown in FIG. 6A, if the late status is excused (block 650—YES), then process 600 may include sending a notification that the late status, associated with user device 110, is excused (block 660). For example, the attendance application may determine that the late status, associated with user device 110, is excused based on information obtained from the personnel data structure and/or the roster data structure. For example, the roster and/or personnel data structure may store information that indicates that the late status is excused when the other user device 110 sends a notification, to application server 150, indicating that the absence is to be excused (e.g., when a parent, doctor, guardian, spouse, etc. sends an excuse that is valid). In another example, the roster and/or personnel data structure may store the information that indicates that the late status is excused when client device 120 sends a notification indicating that the absence is to be excused (e.g., when a supervisor, teacher, etc. sends an excuse that is valid). Based on the determination that the late status is excused, the attendance application may send an excused notification to user device 110, the other user device 110, and/or client device 120 indicating and/or confirming that the late status is excused.

As yet further shown in FIG. 6A, if the retrieved location does not match the assigned location (block 640—NO) (FIG. 6A), then process 600, of FIG. 6B, may include sending an indication that user device 110 is not present (block 665 of FIG. 6B). For example, the attendance application may determine, based on the comparison, that the updated location does not match the assigned location. Based on the determination that the updated location does not match the assigned location, the attendance application may store, in the personnel data structure, a status indication that user device 110 is absent. Additionally, or alternatively, the attendance application may send the status indication to user device 110, the other user device 110, and/or client device 120 that is associated with the group with which user device 110 is associated and/or that corresponds to the assigned location. Client device 120 may receive the status indication and may update the roster data structure based on the status indication.

In another example implementation, the attendance application may retrieve information from the personnel data structure that identifies a quantity of user devices 110 that have been determined to be absent during a particular period of time or on a particular day. Based on the identification of the quantity of user devices 110 that have been determined to be absent, the attendance application may determine whether to schedule or cancel a meeting. In one example, the attendance application may determine that a meeting, that was scheduled for the particular period of time and/or at a particular assigned location, is to be attended by a set of user devices of which one or more of the set of user devices have been identified as being absent. The attendance application may cancel the meeting based on a determination that the quantity of user devices 110, that are scheduled to attend the meeting and which are not absent, is less than a threshold (e.g., a quorum cannot be establish). In another example, the attendance application may schedule a meeting (e.g., an ad hoc meeting) based on a determination that particular user devices 110 are identified as not being absent.

In yet another example implementation, the attendance application may retrieve information from a roster data structure, which identifies a quantity of user devices 110 that have been determined to be absent from a group that is associated with the particular client device 120 and/or that corresponds the particular assigned location during a particular period of time. Based on the identification of the quantity of user devices 110 that have been determined to be absent, the attendance application may determine that all or a portion of a curriculum, work plans, task assignments, etc. associated with the particular period of time were associated with the quantity of user devices 110 that have been determined to be absent. Based on the determination that all or the portion of the curriculum, work plans, task assignments, etc. were associated with the quantity of user devices 110 that have been determined to be absent, the attendance application may send a notification to the particular client device 120 and/or may recommend modified curriculum, work plans, task assignments, etc. that is tailored to user devices 110 that are identified as not being absent.

As also shown in FIG. 6B, if the absence is excused (block 670—YES), then process 600 may include sending a notification that the absence, associated with user device 110, is excused (block 675). For example, the attendance application may determine that the absent status, associated with user device 110, is excused based on information obtained from the personnel data structure and/or the roster data structure. For example, the other user device 110 and/or client device 120 may send a notification, to application server 150, indicating that user device 110 will be absent at a particular period of time and that the absence is to be excused. Application server 150 may receive the notification and may store, in the roster and/or personnel data structure, information indicating that an absent status, associated with user device 110 at the particular period of time, is to be excused. Based on the determination that the absent status is excused, the attendance application may send an excused notification to user device 110, the other user device 110, and/or client device 120 indicating and/or confirming that the absent status is excused.

In another example implementation, the other user device 110 and/or client device 120 may send a notification, to application server 150, indicating that user device 110 will be located outside a geographic area within which user device 110 is authorized to be located and/or at a distance that is greater than a particular distance beyond which user device 110 is not authorized to be located. The notification may indicate that user device 110, when located outside the authorized geographic location and/or beyond the particular distance, is to be excused. Application server 150 may receive the notification and may store, in the roster and/or personnel data structure, information indicating that user device 110 is to be excused when located outside the authorized geographic location and/or beyond the particular distance.

As further shown in FIG. 6B, if the absence is not excused (block 670—NO), then process 600 may include sending an absence notification associated with user device 110 (block 680) and performing an operation to determine whether a potential safety event exists (block 685). For example, the attendance application may determine that the absent status, associated with user device 110, is not excused when the attendance application cannot identify information, within the personnel and/or roster data structure, that indicates that the absent state is excused. Based on the determination that the absent status is not excused, the attendance application may store, in the personnel data structure and/or roster data structure, an indication of an unexcused absence associated with user device 110. Additionally, or alternatively, the attendance application may send an unexcused absence notification to user device 110, the other user device 110, and/or to client device 120 that is associated with the group with which user device 110 is associated and/or that corresponds to the assigned location.

In another example implementation, the attendance application may retrieve, from the personnel data structure, information associated with a quantity of times that user device 110 was associated with an unexcused absence over a time period (e.g., a school year, a quarter, a semester, etc.). The attendance application may compare the quantity of times that user device 110 was associated with the unexcused absence to a threshold to determine whether an absence condition (e.g., corresponding to excessive absenteeism), associated with user device 110, exists. Based on a determination that the quantity of times that user device 110 was associated with the unexcused absence, is greater than the threshold, the attendance application may send a notification to user device 110 and/or the other user device 110, and/or may store, in the personnel data structure, information associated with the absence condition with which user device 110 is associated.

The attendance application may perform an operation to determine whether a potential safety event, associated with user device 110, exists based on the determination that the absence is not excused. In one example, the attendance application may instruct SGW server 140 to identify a location associated with user device 110 to determine whether user device 110 is located in and/or within a close proximity (e.g., based on a threshold) to the assigned location and/or a facility within which the assigned location is located. The attendance application may cause an instruction to be sent to another client device 120 (e.g., associated with a truant officer, a security officer, etc.) to initiate an investigation associated with user device 110.

In another example, the attendance application may send an instruction to user device 110 indicating that a user, of user device 110, is to report to the assigned location or some other location. Additionally, or alternatively, the attendance application may cause a call to be placed to user device 110 that may enable an administrator and/or operator, associated with application server 150 (e.g., a school official, a supervisor, etc.) to converse and/or communicate with the user of user device 110 in order to determine whether a potential safety event has occurred.

In still another example, the attendance application may cause a call to be placed to the other user device 110 that enables an administrator and/or operator, associated with application server 150, to converse and/or communicate with a user of the other user device 110 (e.g., a spouse, a parent, a guardian, etc.) to determine whether the potential safety event exists.

As yet further shown in FIG. 6B, if a potential safety event exists (block 690—YES), then process 600 may include sending a safety notification, associated with user device 110 (block 695). For example, application server 150 may determine, based on the location information associated with user device 110, that user device 110 is located at a distance that is greater than a threshold relative to the assigned location (e.g., when user device 110 is not in close proximity of the assigned location, is not within an authorized boundary defined by a parent, is in another county, is in another state, etc.). Based on the determination that user device 110 is located at the distance that is greater than the threshold, the attendance application may send a safety notification to public server 130 to alert local, state, and/or federal government authorities, an emergency call dispatcher, and/or first responders (e.g., police, fire, and/or medical personnel, etc.) that a potential safety event exists. The safety notification may include the location information that enables a parent and/or first responders, truant officer, and/or other governmental officials to locate user device 110. In another example, the attendance application may determine that user device 110 is located at a hazardous location, may not be able to receive location information associated with user device 110, and/or may not be able to communicate with user device 110 and may determine that a potential safety event exists. In still another example, the attendance application may receive a distress message from user device 110 and/or an operator of application server 150 may determine, based on communications with user device 110, that the user of user device 110 is in distress. In a further example, the attendance application may use the location information to determine whether user device 110 is adhering to posted speed limits (e.g., whether a speed, associated with user device 110, is greater than a threshold, such as when the user is commuting to or from a school, work place, etc.) and/or whether user device 110 was involved in an accident (e.g., when a rate at which a speed, corresponding to user device 110 changes, such as during a deceleration or acceleration, exceeds a threshold). Based on a determination that user device 110 is not adhering to posted speed limits (e.g., traveling at excessive speed that is greater than a threshold relative to a posted speed limit) and/or is involved in an accident. The attendance application may send a safety notification to another user device 110 (e.g., associated with a parent) and/or public server 130 to alert local, state, and/or federal government authorities.

As still further shown in FIG. 6B, if a potential safety event does not exist (block 690—NO), then process 600 may end. For example, application server 150 may determine, based on the location information associated with user device 110, that user device 110 is not located at a distance that is greater than a threshold relative to the assigned location (e.g., when user device 110 is in close proximity of the assigned location). Based on the determination that user device 110 is located at the distance that is not greater than the threshold, attendance application may determine that a safety event, associated with user device 110, does not exist. In another example, the attendance application may determine that a safety condition does not exist based on a determination that user device 110 is located at a location that corresponds with the other user device 110 (e.g., which may indicate that the user is accompanied by a parent, guardian, etc.) and/or that the user is not located at a hazardous location. In still another example, the attendance application may receive a notification, from the other user device 110 indicating that the whereabouts of user device 110 are known and/or that the absence is excused. In an example implementation, the attendance application may cause a notification to be sent to another client device 120 (e.g., with which a truant officer and/or a security officer is associated) that includes an instruction for the user device 110 to be located and/or that the user be caused to attend class (e.g., associated with the assigned location).

Systems and/or methods, described herein, may enable an attendance application to automatically determine whether a user, associated with a user device, is present or absent based on location information associated with the user device. The systems and/or methods may use information associated with whether a user device is present, tardy, or absent relative to a particular location (e.g., a school, a work place, a class room, a bus, etc.) to generate and/or update information associated with the user (e.g., attendance records, class rosters, personnel records, payroll records, etc.). The systems and/or methods may determine whether a potential event, associated with the user, exists by determining whether the user device is missing, is excused from being absent, is excused from being late, etc. The systems and/or methods may perform an operation to locate the user device in the event of an unexcused absence and/or when a potential event is detected. The systems and/or methods may send notifications to the user device, another user device (e.g., associated with a parent, a physician, a guardian, spouse, etc. of the user), a client device (e.g., associated with a teacher, an administrator, a supervisor, etc. of the user), and/or governmental authorities (e.g., first responders and/or local, state, and/or federal officials, etc.). The notifications may identify a status of the user device (e.g., on time, tardy, absent, etc.), a presence of the user device (e.g., present or not present), whether a late or absent status is excused, and/or whether a potential event has been detected. The systems and/or methods may generate reports, such as personnel listings, class room rosters, attendance reports (e.g., a quantity of incidences of tardiness, absence, etc.), curriculum reports, etc.

The systems and/or methods may enable less time to be spent managing attendance of personnel, which may permit more time to be spent performing other duties. The systems and/or methods may permit the amount of time and/or funds associated with performing attendance data retrieval, attendance audits, record keeping, and/or reporting to be reduced. The attendance application may enable parents and/or supervisors to be kept informed as to the location and/or attendance status of children and/or employees, respectively.

The foregoing description provides illustration and description, but is not intended to be exhaustive or to limit the implementations to the precise form disclosed. Modifications and variations are possible in light of the above teachings or may be acquired from practice of the embodiments.

While series of blocks have been described with regard to FIGS. 4, 6A, and 6B, the order of the blocks may be modified in other implementations. Further, non-dependent blocks may be performed in parallel.

It will be apparent that systems and methods, as described above, may be implemented in many different forms of software, firmware, and hardware in the implementations illustrated in the figures. The actual software code or specialized control hardware used to implement these systems and methods is not limiting of the implementations. Thus, the operation and behavior of the systems and methods were described without reference to the specific software code—it being understood that software and control hardware can be designed to implement the systems and methods based on the description herein.

Further, certain portions, described above, may be implemented as a component or logic that performs one or more functions. A component or logic, as used herein, may include hardware, such as a processor, an ASIC, or a FPGA, or a combination of hardware and software (e.g., a processor executing software).

It should be emphasized that the terms "comprises" and/or "comprising," when used in this specification, are taken to specify the presence of stated features, integers, steps or components but does not preclude the presence or addition of one or more other features, integers, steps, components or groups thereof Even though particular combinations of features are recited in the claims and/or disclosed in the specification, these combinations are not intended to limit the disclosure of the embodiments. In fact, many of these features may be combined in ways not specifically recited in the claims and/or disclosed in the specification. Although each dependent claim listed below may directly depend on only one other claim, the disclosure of the embodiments includes each dependent claim in combination with every other claim in the claim set.

No element, act, or instruction used in the present application should be construed as critical or essential to the embodiments unless explicitly described as such. Also, as used herein, the article "a" is intended to include one or more items. Where only one item is intended, the term "one" or similar language is used. Further, the phrase "based on" is intended to mean "based, at least in part, on" unless explicitly stated otherwise.

What is claimed is:

1. A method comprising:

receiving, by a server device, information associated with a location of a user device;

retrieving, by the server device and from a memory associated with the server device, information associated with a personnel data structure, where the personnel data structure includes information associated with an assigned location at which a user of the user device is to be during a period of time, and wherein the period of time begins at a first point of time and ends at a second point of time, and the second point of time is different from the first point of time;

determining, by the server device, whether to assign, to the user device, a late status or an absent status based on the location of the user device, the assigned location, and the period of time;

assigning, by the server device and to the user device, the late status in response to determining that the location of the user device does not match the assigned location when the period of time begins;

sending, by the server device and to another user device or another server device, a first notification that the user device is late to the assigned location based on the assigning of the late status, where the other user device is associated with a parent or guardian of the user, and where the other server device is associated with a teacher or supervisor of the user;

assigning, by the server device and to the user device, the absent status in response to determining that the location of the user device does not match the assigned location during the period of time;

sending, by the server device and to the other user device or the other server device, a second notification that the user was absent from the assigned location in response to assigning the absent status to the user device;

determining that the absent status, assigned to the user device, is not excused when the personnel data structure does not store information that indicates that the absent status is to be excused;

determining whether a distance, between the assigned location and the location associated with the user device, is greater than a threshold based on the determination that the absent status is not excused; and sending, to a third server device, a third notification indicating that a safety event, associated with the user device, exists based on determining that the distance is greater than the threshold.

2. The method of claim 1, further comprising:

assigning, to the user device, an on-time status in response to determining that the location of the user device matches the assigned location when the period of time begins; and storing, in the personnel data structure, information indicating that the user device was on time to the assigned location based on the assigning of the on-time status.

3. The method of claim 1, further comprising:

retrieving, from the personnel data structure, information that indicates that the absent status is to be excused, where the information that indicates that the absent status is to be excused was stored in the personnel data structure, in response to receiving, at a prior point of time relative to the period of time, from the other user device or the other server device, a notification that the absent status is to be excused; and excusing the absent status based on the retrieved information that indicates that the absent status is to be excused.

4. The method of claim 1, further comprising:

determining that the late status is not excused when the personnel data structure does not store information that indicates that the late status is to be excused; and sending a fourth notification to the other user device or the other server device indicating that the user device was tardy during the period of time based on determining that the late status is not excused.

5. The method of claim 4, further comprising:

updating the personnel data structure based on the fourth notification indicating that the user device was tardy, where updating the personnel data structure includes storing information indicating that the user device was tardy during the period of time;

identifying, from the updated personnel data structure, a plurality of indications that the user device was tardy within a particular period of time;

determining that a tardiness condition, associated with the user device, exists based on a determination that the quantity of the indications that the user device was tardy, is greater than a threshold; and sending, to the other user device, a fifth notification that the tardiness condition exists.

6. The method of claim 1, wherein the third server device is associated with local, state, or federal government authorities.

7. The method of claim 1, further comprising:

identifying that two or more user devices are present based on a determination that the two or more user devices are located at respective assigned locations, each corresponding to one of the two or more user devices;

determining that a quantity of the two or more user devices is greater than a threshold value in response to identifying that the two or more user devices are present, where the threshold corresponds to a minimum quantity of user devices to be present in order to establish a quorum; and scheduling a meeting in response to determining that the quantity of the two or more user devices is greater than the threshold value.

8. The method of claim 1, further comprising:

clocking in the user device when the user device enters a room that corresponds to the assigned location;

in response to clocking in the user device, storing, in the personnel structure data, information indicating a first time that corresponds to a point in time at which the user device was clocked in;

clocking out the user device when the user device leaves the room that corresponds to the assigned location;

in response to clocking out the user device, storing, in the personnel structure data, information indicating a second time that corresponds to a point in time at which the user device was clocked out; and determining whether the user device was present for a full period of time based on whether a time period from the first time to the second time is greater than the full period of time.

9. The method of claim 1, further comprising:

receiving, from the user device, a request to set up an account, where the request includes set up information associated with the user device, the set up information including information associated with the user device, one or more assigned locations, and one or more periods of time that correspond to the one or more assigned locations; and setting up, in response to the request, the account, wherein setting up the account includes at least one of:

storing the set up information in a set up data structure associated with the user device, storing all or a portion of the information in the personnel data structure, or storing all or a portion of the information in a roster data structure that corresponds to the one or more assigned locations at which the user device is to be located for the one or more periods of time.

10. A server device, comprising:

a memory to store a data structure that includes information associated with a schedule of locations at which a user device is to be present during a plurality of non-overlapping time periods, where the plurality of non-overlapping time periods correspond to the respective locations; and a processor to:

receive information associated with a location of the user device, identify, from the information associated with the schedule of locations, an assigned location at which the user device is scheduled to be present during a period of time of the plurality of non-overlapping time periods, wherein the period of time begins at a first point in time and ends at a second point in time, and the second point in time is different from the first point in time, determine that the user device is not present at the assigned location when the location of the user device does not match the assigned location from the first point in time to the second point in time, determine whether the data structure stores information indicating that the user device is excused from being present at the assigned location, send, to another server device, a first notification that the user device is excused from being present at the assigned location, in response to determining that the data structure stores the information indicating that the user device is excused from being present at the assigned location, where the other server device is associated with the assigned location, send, to another user device, a second notification that the user device is absent at the assigned location, in response to determining that the data structure does not store the information indicating that the user device is excused from being present at the assigned location, where the other user device is associated with a parent or guardian of the user, perform a security operation to determine whether a security condition, associated with the user device, exists based on the determination that the user device is not present, send a query to the user device to obtain updated information associated with the location of the user device, determine that the user device is located at a distance that is not greater than a threshold relative to the assigned location based on the updated information associated with the location of the user device, and send a third notification to the other user device or the other server device indicating that the security condition, associated with the user device, does not exist based on the determination that the user device is located at the distance that is not greater than the threshold.

11. The server device of claim 10, where, when performing the security operation, the processor is further to:

send a query to the user device to obtain updated information associated with the location of the user device, determine that the user device is located at a distance that is greater than a threshold relative to the assigned location, and send a fourth notification to the other user device or a third server device indicating that the security condition, associated with the user device, exists, where the third server device is associated with local, state, or federal government authorities.

12. The server device of claim 10, where the processor is further to:

update a roster data structure associated with the assigned location, where, in response to updating the roster data structure, the processor is to store information indicating that the user device is absent, and where the roster data structure includes information associated with a plurality of user devices that are scheduled to be present at the assigned location.

13. The server device of claim 12, where the processor is further to:

identify that one or more user devices, of the plurality of user devices, are not present at the assigned location, determine that all or a portion of a curriculum was associated with the one or more user devices that are not present, and generate a modified curriculum that is associated with the portion of the plurality of user devices that are present at the assigned location, where the modified curriculum does not include all or the portion of the curriculum associated with the one or more user devices that are not present.

14. The server device of claim 10, where, when determining that the user device is not present, the processor is further to:

identify that the user device is not present when the location of the user device does not match the assigned location at starts first point in time, and send, to the other user device or to the other server device, a fourth notification that the user device is late when the location of the user device does not match the assigned location at starts first point in time.

15. The server device of claim 14, where the processor is further to:

receive a fifth notification from the other user device that indicates that the user device is excused from being late to the assigned location, and store, in the data structure and based on the fifth notification, an indication that the user device is excused from being late to the assigned location.

16. The server device of claim 10, where the processor is further to:

retrieve, from the memory, information that indicates that a portion of a plurality of user devices, which are scheduled to be present at a plurality of assigned locations, are not present, identify that one or more user devices, of another portion of the plurality of user devices that are present, are scheduled to attend a meeting at a particular assigned location, determine that a quantity of the one or more user devices is less than a threshold value above which the meeting is authorized to be held, and send a message that cancels the meeting based on the determination that the quantity of the one or more user devices is less than the threshold value.

17. A non-transitory computer-readable medium containing instructions executable by at least one processor, the computer-readable medium comprising:

one or more instructions to receive information associated with a location of a user device;

one or more instructions to determine whether the user device is present at a particular location at which the user device is scheduled to be located during a period of time based on the information associated with the location of the user device, wherein the period of time begins at a first point of time and ends at a second point of time, and the second point of time is different from the first point of time;

one or more instructions to determine whether the user device is excused from being present at the particular location based on a determination that the user device is not present at the particular location;

one or more instructions to send, to another device, a first notification that the user device is excused from being present based on a determination that the user device is excused;

one or more instructions to send a second notification to another user device indicating that the user device is not present at the particular location based on a determination that the user device, not being present at the location, is not excused;

one or more instructions to send a third notification to the user device instructing the user of the user device to report to the location or to respond to the second notification based on a determination that absence of the user device, at the particular location, is not excused;

one or more instructions to update a data structure associated with an assigned location, and store information indicating that the user device is absent, and wherein the data structure includes information associated with a plurality of user devices that are scheduled to be present at the assigned location;

one or more instructions to identify that one or more user devices, of the plurality of user devices are not present at the assigned location;

one or more instructions to determine that all or a portion of a curriculum was associated with the one or more user devices that are not present; and one or more instructions to generate a modified curriculum that is associated with the portion of the plurality of user devices that are present at the assigned location where the modified curriculum does not include all or the portion of the curriculum associated with the one or more user devices that are not present.

18. The non-transitory computer-readable medium of claim 17, where the one or more instructions to determine whether the user device is present at the particular location further includes:

one or more instructions to determine whether the location of the user device matches the particular location at which the user device is scheduled to be located at a point in time that is within the period of time;

one or more instructions to store, in the data structure associated with the user device, first information indicating that the user device is present based on a determination that the location of the user device matches the particular location at which the user device is scheduled to be located at the point in time; and one or more instructions to store, in the data structure, second information indicating that the user device is not present based on a determination that the location of the user device does not match the particular location at which the user device is scheduled to be located at the point in time.

19. The non-transitory computer-readable medium of claim 17, further comprising:

one or more instructions to retrieve, from the data structure, information that identifies one or more occurrences of when the user device was not present at one or more locations at which the user device was scheduled to be located over a particular period of time; and one or more instructions to send, to the other user device, a fourth notification that the user device has not been present an excessive quantity of times when a quantity associated with the one or more occurrences is greater than a threshold.

20. The non-transitory computer-readable medium of claim 17, further comprising:

one or more instructions to receive a fourth notification from the other user device that indicates that the user device will not be present at a certain location that corresponds to a particular point in time; and one or more instructions for excusing the user device for not being present at the certain location that corresponds to the particular point in time based on the fourth notification from the other user device.

21. The non-transitory computer-readable medium of claim 17, further comprising:

one or more instructions to determine that the user device is located at a distance, from the particular location at which the user device is schedule to be located, that is greater than a threshold; and one or more instructions to place a call to the other user device, that permits a user of the other user device to communicate with an administrator to determine whether the user device is authorized to be at the distance that is greater than the threshold; and one or more instructions to send a fourth notification to a server device indicating that a potential safety event, associated with the user device, exists, where the server device is associated with local, state or federal government authorities or first responders.

22. The non-transitory computer-readable medium of claim 17, further comprising:

one or more instructions to receive an alert that indicates that inclement weather may affect a plurality of user devices scheduled to be at the particular location at which the user device is scheduled to be located during a future period of time; and one or more instructions to broadcast a fourth notification to the plurality of user devices instructing the plurality of user devices not to report to the particular location at which the user device is scheduled to be located during the future period of time.

23. The non-transitory computer-readable medium of claim 17, further comprising:

one or more instructions to receive, from the other user device, a fourth notification that a particular medication, to be taken by the user of the user device at a particular point in time, is authorized;

one or more instructions to store, in a data structure, information associated with the particular medication to be taken by the user at the particular point in time; and one or more instructions to send, to the user device or to a server device at the particular point in time, an instruction that the medication is to be taken, where the server device is associated with a person that is located at the particular location at which the user device is scheduled to be located at the particular point in time.

* * * * *